US005706891A

United States Patent [19]

Schraub

[11] Patent Number: 5,706,891

[45] Date of Patent: Jan. 13, 1998

[54] GRAVEL PACK MANDREL SYSTEM FOR WATER-FLOOD OPERATIONS

[75] Inventor: John D. Schraub, Huntsville, Tex.

[73] Assignee: Enterra Petroleum Equipment Group, Inc., Houston, Tex.

[21] Appl. No.: 591,762

[22] Filed: Jan. 25, 1996

[51] Int. Cl.[6] ..... E21B 23/03

[52] U.S. Cl. ..... 166/51; 166/117.5; 166/242.3

[58] Field of Search ..... 160/242.3, 117.5, 160/205, 305.1, 51

[56] References Cited

U.S. PATENT DOCUMENTS

| | | | |
|---|---|---|---|
| 4,462,465 | 7/1984 | Strickland | 166/117.5 |
| 4,646,839 | 3/1987 | Rickey | 166/51 X |
| 5,042,584 | 8/1991 | Terral | 166/305.1 |

*Primary Examiner*—William P. Neuder

*Attorney, Agent, or Firm*—James L. Jackson; Gary L. Bush; Eugene N. Riddle

[57] ABSTRACT

A gravel packed water-flood fluid injection mandrel is provided for a water-flood well which includes a side pocket having flow control device therein for injection of pumped water-flood fluid from the mandrel into a subsurface formation of interest. A gravel pack screen system is supported by the mandrel and is positioned so that injected water-flood fluid being discharged by the flow control device will flow through a perforate tubular member having a surrounding particulate exclusion screen. The gravel pack screen system is also arranged so that backflowing fluid flowing from the formation after termination of water-flood operations will be screened to exclude harmful particulate matter that might be entrained in the backflowing fluid. Thus, the flow control device of the mandrel will be protected against erosion or other damage by the gravel pack screen system which excludes predetermined particulate matter from the backflowing fluid.

17 Claims, 2 Drawing Sheets

FIG. 3
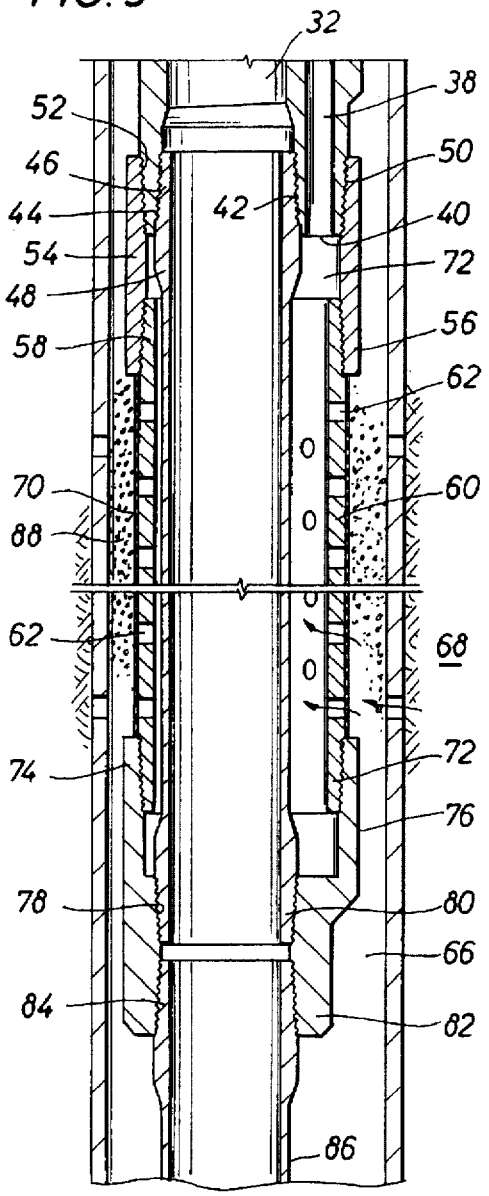
FIG. 6
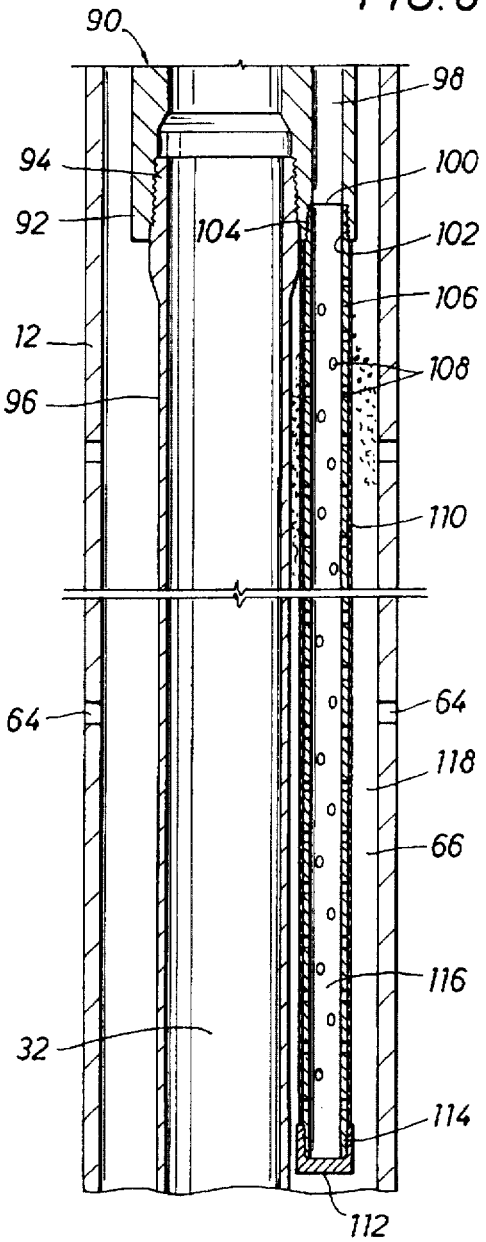
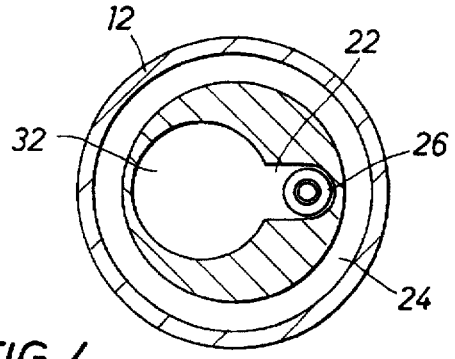
FIG. 4
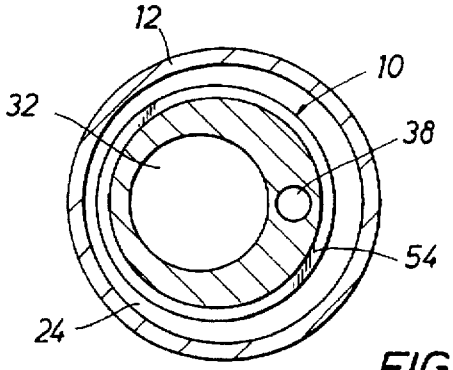
FIG. 5

GRAVEL PACK MANDREL SYSTEM FOR WATER-FLOOD OPERATIONS

FIELD OF THE INVENTION

This invention relates generally to water-flood operations wherein water or a mixture of water and formation treating fluids is injected into subsurface earth zone for the purpose developing a water drive for production of oil and other petroleum products in adjacent wells being completed in the same production zone. More specifically, the present invention is directed to a water-flood mandrel of a water injection tubing string having a flow control device located in a pocket thereof and controlling injection of water from the injection tubing string into the subsurface formation. Even more specifically, the present invention involves a water injection mandrel having in fluid communicating connection therewith a gravel pack screen which, under backflow conditions, serves to exclude water entrained sand and other debris from the backflowing fluid control device, thus protecting the flow control device from erosion and other damage by particulate that might otherwise flow through the flow control device along with the backflowing water.

BACKGROUND OF THE INVENTION

While the present invention is disclosed particularly as it relates to water-flood operations, i.e. injection of water into subsurface formations to develop a water drive for connate fluid contained therein, it is not intended to limit the scope of the invention to water injection. Other fluids, such as formation treating fluid, may be injected into a subsurface formation in the same manner. The term "water" is therefore intended to encompass a wide range of injected liquid compositions for a wide range of purposes.

Under circumstances where oil bearing earth formations, i.e. subsurface production zones lack sufficient pressure for production of oil and other hydrocarbons contained therein, one method of achieving production of the subsurface zone is to inject water into the zone from a water injection well. Water is injected from the well into the production zone under pressure that develops a water drive causing migration of the water, oil and other petroleum products through the production zone in a direction away from the injection well. With the production zone thus pressurized via injected water from the water-flood injection well, petroleum products can be produced in adjacent wells that are completed in the production zone. In cases where two or more production zones are intersected by the well bore, these production zones are often completed and the respective production zones are produced by water-flood operations through injection of water into the respective production zones from a plurality of water-flood mandrels that are provided in an injection tubing string. In many cases, these production zones differ in water drive pressure. If they are in fluid communication water from a higher pressure zone can flow to and into a zone of lesser pressure. Water is then pressurized by pumps located at the surface and the pressurized water exits the water-flood injection string at one or more water-flood mandrels. Each of these mandrels will be provided with one or more flow control pockets, each containing therein a flow control device that permits flow of injection water therethrough at a desired pressure and rate of flow. The flow control device is typically in the form of a retrievable valve mechanism having an internal valve that opens at a desired pressure range to permit flow of injected therethrough.

The flow control pocket of the mandrel defines an injection port that injects water at a pressure controlled by the flow controller into the annulus between the injection tubing string and the well casing. This pressurized water will then enter the production zone through perforations in the well casing where it then propagates through the subsurface earth formation and provides water drive pressure to the petroleum products contained in the formation. In many cases, the injected water will be laden with surfactant or other formation treating composition that assists in propagation of the water and the petroleum products through the subsurface formation and causes release or separation of the petroleum products from the formation material.

When pressurized water injection into the formation is terminated, for any period of time, the water pressure previously generated in the formation and perhaps the presence of other adjacent water injection wells will in most cases cause backflow of water from the formation through the casing perforations and through the flow control device into the water injection tubing string. Under such circumstances, if the backflowing water contains sand and other particulate, the sand will often cause erosion of internal flow controller components such as the valve seat, valve element, valve body, etc. It is desirable therefore to provide a water injection system of this nature having the capability of accommodating water backflow conditions and yet protecting the flow control device from damage by sand and other particulate that might be contained within the backflowing water.

Water backflow can also occur when water injection operations are terminated and water is caused to flow by formation pressure from one production zone having a particular pressure to another production zone intersected by the well which is of lower pressure. When this condition occurs, water backflow conditions can continue for a virtually indefinite period, so that a flow control valve or other mechanism within the side pocket of the mandrel can be slowly and continuously eroded or otherwise damaged by particulate matter that is entrained within the backflowing fluid. Although pressured induced backflow interchange between different subsurface zones is not inherently disadvantageous, such becomes disadvantageous to the flow control device of the mandrel under circumstances where the backflowing fluid contains a significant quantity of sharp grained sand and other particulate matter. It is desirable, of course, to ensure that under backflowing conditions, whether from a production zone to the injection tubing or from one production zone to a lower pressure zone that the backflowing fluid entering the flow control device be substantially free of sand and other particulate matter that might cause damage to the flow control device.

SUMMARY OF THE INVENTION

It is a principal feature of the present invention to provide a novel water-flood mandrel including a conventional water flow control device and further incorporating an elongate gravel pack system through which injected water must pass from the injection tubing into the well casing and through which water must pass during any backflow conditions so that water backflowing through the flow control device will be substantially free of sand and other particulate matter.

It is another feature of the present invention to provide a water-flood mandrel having incorporated in integrated assembly therewith a gravel pack screen system for separation of particulate from backflowing water.

It is also a feature of this invention to provide a novel water-flood mandrel having a gravel pack screen assembly that also provides structural support for water injection tubing located below it.

Briefly, there is provided according of the spirit and scope of the present invention, a gravel pack water injection mandrel system having a side pocket type mandrel that is connected into a water injection tubing string. In the event the well is completed at more than one production zone, a water injection mandrel may be provided in the water injection tubing string at the depth of each production zone. The mandrel incorporates a side pocket defining a water inlet in communication with the flow passage of the mandrel and a water injection port which opens externally of the water injection tubing to which the mandrel is connected for delivery of pressurized water into the well casing or well bore at formation depth.

At the lower end of the mandrel, there is connected a perforated pipe of a desirable length, having a gravel pack screen externally thereof and being of desired screen dimension for exclusion of particulate to a predetermined size. This gravel pack section is arranged so that injection water exiting the injection port of the mandrel must flow through the gravel pack screen in route to the completion perforations of the well casing. Under conditions of backflow, which typically occur when water injection operations are suspended, water flowing from the casing perforations into the casing, and hence through the injection port and through the flow control valve mechanism into the injection tubing string must pass through the gravel pack screen. Thus, any particulate such as sand and other debris that may be entrained in the backflowing injection water will be excluded from the backflow before it enters the injection port of the mandrel pocket. The water entering the mandrel pocket and passing through the flow control valve mechanism thereof will be substantially free of particulate that might erode or cause other damage to the flow control device.

If desired, the gravel pack screen may be in the form of a large, elongate gravel pack screen that surrounds the water injection tubing below the mandrel. In the alternative, the elongate gravel pack screen may be of small diameter and may be offset to one side of the water injection tubing. As a further alternative, the gravel pack screen may be arranged in any suitable manner appropriate for achieving separation of sand and other particulate from the backflowing injection water to thus prevent backflow of the particulate through the control valve mechanism of the mandrel. This will prevent the flow control mechanism from being eroded or otherwise damaged by particulate passing therethrough along with the backflowing water.

BRIEF DESCRIPTION OF THE DRAWINGS

So that the manner in which above recited features, advantages and objects of this invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrated only typical embodiments of this invention, and are, therefore, not to be considered limiting of its scope for the invention may admit to other equally effective embodiments.

In The Drawings:

FIG. 1 is a sectional view of an upper portion of the gravel pack water injection mandrel of the present invention, showing the same positioned within a well casing.

FIG. 2 is a sectional view of an intermediate portion of the gravel pack water injection mandrel shown in FIG. 1.

FIG. 3 is a sectional view of a lower portion of the gravel pack water injection mandrel of FIG. 1.

FIG. 4 is a transverse sectional view of the gravel pack mandrel taken alone line 4—4 of FIG. 2.

FIG. 5 is a transverse sectional view taken along line 5—5 of FIG. 2.

FIG. 6 is a sectional view showing the lower portion of a gravel pack mandrel representing an alternative embodiment of the present invention and having a tubular gravel pack screen located to one side of the tubing string of the well.

DETAILED DESCRIPTION OF PREFERRED EMBODIMENT

Figure 1:
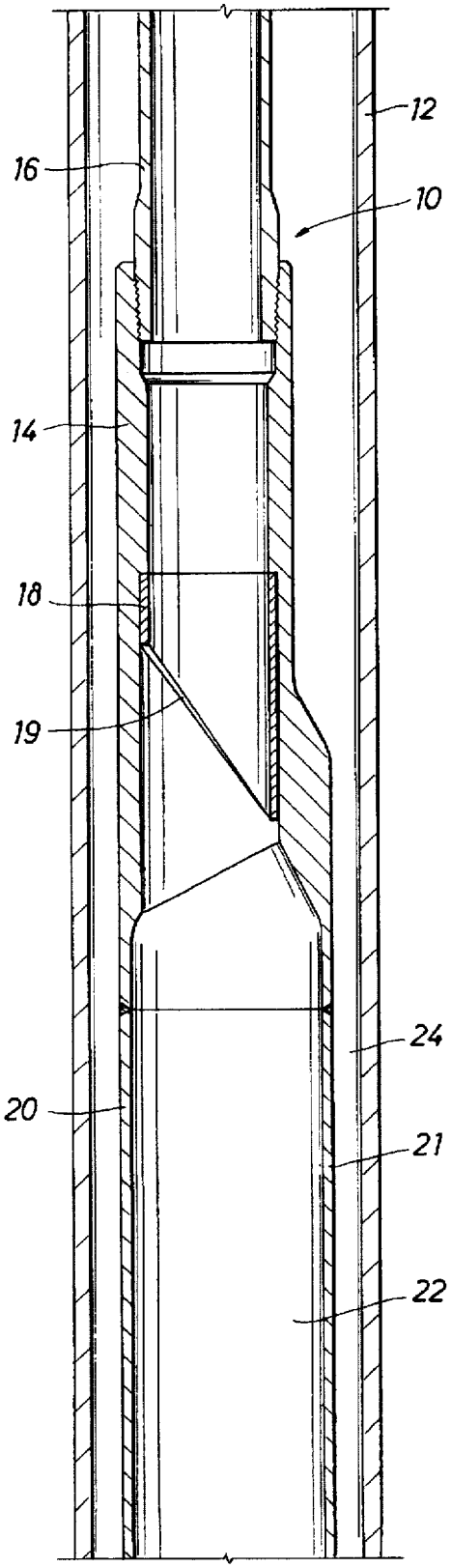
Figure 2:
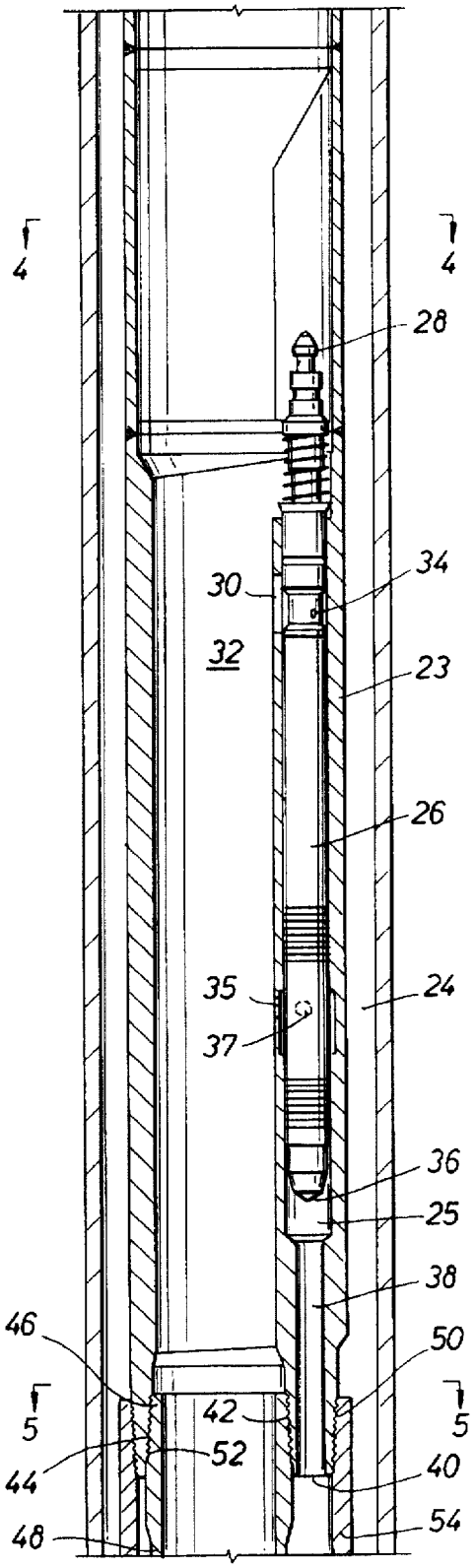

Referring now to the Drawings and first to FIGS. 1 and 2, a gravel pack type water-flood mandrel is shown generally at 10 and is adapted for location within a well casing 12 or within an open well bore intersecting one or more subsurface formations of interest. The mandrel 10 is provided at its upper extremity with an internally threaded tubular connection section 14 that is adapted for threaded connection with the lower externally threaded extremity of a section 16 of water injection tubing string through which water or any other liquid materials are injected into the formation of interest. Internally, the mandrel is provided with a tubular orienting sleeve 18 having an inclined, downwardly facing, annular orienting surface 19 which is disposed for orienting engagement by an upwardly moving kick-over tool to orient the tool for registry with a side pocket of the mandrel for installation or removal of a flow control device from the side pocket.

The mandrel 10 is provided with an intermediate tubular mandrel section 20 which defines an elongate offset side pocket section 21 defining an internal side pocket receptacle 22 which is adapted to receive a kick-over tool when the tool is oriented laterally by the orienting sleeve. The tool orienting structure of the mandrel is of conventional construction and function. At its lower portion the mandrel 10 is provided with a side pocket structure 23 having its upper end in communication with the side pocket receptacle and defining a discharge opening in communication with the annulus 24 between the water injection conduit of the mandrel and the well casing or bore hole. The side pocket structure 23 defines a generally cylindrical internal pocket or receptacle 25 which is adapted to receive a flow control device 26 in sealed and seated relation therein. The water injection regulating valve mechanism 26 can be of the type shown in U.S. Pat. No. 5,042,584 of Terral, which permits backflow of casing fluid to the injection tubing string when injection flow is terminated and tubing pressure at the valve mechanism becomes lower than casing pressure. The flow control device is provided with a conventional fishing neck 28 at the upper end thereof for connection with the lower connection end of a kickover tool which is employed for installation and removal of the flow control device while the mandrel tubing remains in the well. The side pocket structure 23 defines a fluid inlet 30 that communicates the flow passage 32 of the mandrel with the internal pocket or receptacle of the side pocket structure. In this regard, it should be borne in mind the inlet flow from the injection passage into the flow control device may occur at the top of the latch of the flow control device or at other locations that may be desired. The location of the inlet 30 is therefore intended as representative rather than restrictive. The flow control device 26 also defines one or more fluid inlet openings 34 through which water or other injected fluid flows at flow passage pressure into the flow control mechanism and defines a discharge opening 36 for pressure controlled discharge of water into the lower end of the pocket 25. It should be borne in mind that inlet flow into the flow control device may be through the top of the latch. Below the internal pocket or receptacle 25 the side pocket structure defines a water discharge passage 38 having a discharge opening 40 that communicates the discharge passage with the annulus between the mandrel and well casing via a gravel pack screen assembly to be described in detail hereinbelow. As shown in FIG. 2, the side pocket may be provided with an inlet opening 35 located between the packings of the flow control device if desired. In this case, the flow control device would be provided with an inlet opening 37 as shown by broken lines.

At its lower end the mandrel defines an internally threaded section 42 which is adapted for connection with the external threads 44 of the upper end 46 of a fluid injection conduit section 48. The lower end of the mandrel also defines an external threaded 50 of significantly greater diameter as compared to the diameter of the internal threaded section 42 and encompassing and being in eccentric relation with the internal threaded section 42. The external connection thread 50 of the lower end of the mandrel is received by the internal thread 52 of the upper end of a gravel pack screen coupling member 54. The lower internally threaded end 56 of the gravel pack screen coupling 54 threadedly receives the upper externally threaded end 58 of an elongate tubing section 60 having a multitude of perforations 62 formed therein. The perforate tubular member 60 may be of any desirable length and for that reason is shown broken in FIG. 3. Preferably the gravel pack mandrel assembly will be installed in the well with the perforations 62 of the perforate tubular member located adjacent the completion perforations 64 of the well casing which communicate the casing passage 66 with the formation of interest 68. Obviously, when the well is of the open bore type, without a casing having been installed to line the bore hole at the subsurface zone being injected by water-flood, the perforate tubular member would be preferably located at or near the depth of the subsurface zone of interest. A gravel pack screen 70 is disposed in close fitting relation about the external surface of the elongate perforate tubular member with the respective upper and lower ends thereof located about respective non-perforate upper and lower sections of the elongate perforate tubular member. Preferably, the gravel pack screen will be fixed to the elongate perforate member by brazing or by any other suitable means of connection.

The discharge port 40 is oriented for discharge of injection fluid into the annulus 72 between the coupling member 54 and the injection tubing 48 so that water being discharged from the discharge port must flow through the elongate perforate tubular member and the gravel pack screen before reaching the casing annulus and then flowing through the casing perforations and into the formation of interest. Conversely, when a water injection regulating valve of the type shown in U.S. Pat. No. 5,042,584 is utilized, upon cessation of water-flood injection, when a condition of water-flood back-flow occurs fluid flowing from the formation of interest and into the well casing or well annulus must pass through the gravel pack screen before entering the elongate perforate tubular member and then back-flowing through the flow control device. The gravel pack screen will separate any entrained particulate of a desired size range from the back-flowing fluid, thus ensuring that the flow control device and other internal components of the gravel pack water-flood mandrel will be protected against erosion by the entrained particulate which is almost always present in the backflowing water-flood fluid.

The lower end of the perforate tubular member 60 is provided a with an externally threaded section 72 which is received by the internally threaded upper end 74 of a connector member 76. The connector member is provided with an internally threaded section 78 which is oriented eccentrically with respect to the threaded connection between the perforate tubular member 60 and the connector member 76 and receives the lower externally threaded end 80 of the fluid injection conduit section 48 in threaded assembly therewith. At its lower end, the connector member 76 is provided with an internally threaded section 82 which is adapted to receive the externally threaded upper end 84 of an injection conduit section 86 as shown at the lower portion of FIG. 3. It should be born in mind that the connector member 76 may be of any other suitable design that is appropriate for structural connection of the injection conduit sections 48 and 86 and the perforate tubular member 60. Thus, it is not intended that the present invention be restricted to the specific structure that is set forth in FIG. 3.

During operation of the water-flood system of the well, water is forced at pump energized pressure through the flow passage 32 to the water-flood mandrel. The pressurized water then enters the flow control side pocket 25 through inlet port 30 and then flows at pumped pressure through inlet ports 34, into the flow control device 26. The flow device is typically in the form of a conventional flow control valve which then controls discharge of water-flood fluid from discharge openings 36 into the side pocket receptacle 25. The fluid exiting the flow control device will typically exit at a predetermined fluid pressure that is designed according to the particular conditions of the formation of interest. The injected fluid then flows through discharge passage 38 and discharge opening 40 into the annulus between the injection conduit section 48 and the perforate tubular member 60 which is support by the coupling member 54. This injected fluid then exits the perforate tubular member 60 via perforations 62 and then flows through the casing perforations into the formation of interest.

Externally of the water-flood mandrel and within the casing or well bore, the well is typically provided with a gravel pack 88 which occurs when a quantity of course grained sand or gravel is injected into the well typically via gravel pack crossover. This gravel pack will be located externally of the gravel pack screen 70. As long as water-flood operations are being conducted, the injected water-flood fluid will continuously flow from the mandrel under the control of the flow control device and will continuously flow into the formation of interest at water-flood pressure. Upon cessation of water-flood activities, the pressurized water-flood fluid that is within the formation of interest together with other fluid materials that might be present in the formation will then flow from the formation through the casing perforations or from the well bore into the well. Since the pressure within the flow passage 32 will typically be less than the pressure of the formation of interest, this fluid will then backflow through the screen 70, the perforations 62 and hence through flow passage 38 into the flow control device. Typically, a quantity of particulate being entrained within backflowing fluid will flow from the formation into the well bore. The gravel pack screen 70, however, will exclude a majority of this particulate from the backflowing fluid so that the flow of backflowing liquid through the flow control device will be substantially free of any particulate. Thus, the flow control device will protected against the particulate induced erosion that might otherwise occur.

In many cases, a well bore will intersect two or more formations of interest and these formations may be at a different formation pressure. Upon cessation of water-flood operations, fluid may be discharged from one subsurface formation at a particular pressure and may then flow toward and into a subsurface formation at a lower pressure. This backflowing fluid can continuously flow through a flow control device thus eroding the flow control device within a relatively short period of time. The gravel pack screen mechanism in association with the water-flood mandrel system of the present invention provides protection of the flow control device from erosion by contaminates that might be present within the backflowing fluid.

It is noted especially with respect to FIG. 3 that the perforate tubular member 60 is positioned so as to encompass the injection conduit section 48 so that the perforate tubular member 60 is of significantly greater diameter as compared to the diameter of the fluid injection conduit section. Although this type of gravel pack screen system is preferable from the standpoint of the present invention, an alternative embodiment of the present invention is shown in FIG. 6. Like parts will be referred to by like reference numerals. In FIG. 6, a water-flood mandrel is shown generally at 90 having a lower internally threaded extremity 92 which is adapted to receive the upper externally threaded extremity 94 of a fluid injection conduit section 96. The mandrel 90 which is constructed in similar manner as described above in connection with mandrel 10 is provided with a side pocket containing a flow control device such as that shown at 26 and further defines a discharge passage 98 having a discharge opening 100. The lower end of the mandrel 90 defines an offset internally threaded opening 102 which is adapted to receive the upper externally threaded end 104 of an elongate tubular element 106 having a multitude of perforations 108. The tubular element 106 is encompassed by a screen member 110 that is fixed about the external surface of the tubular element in any suitable manner. The lower end of the tubular element 106 is closed by an internally threaded closure plug 112 that is adapted to receive the externally threaded lower end 114 of the perforate tubular element.

During water fluid operations, the injected water-flood fluid flows downwardly through the flow passage 32 to the flow control device and when discharged from the flow control device, flows through discharge passage 98 into the internal passage 116 of the perforate tubular element 106. This pressurized water-flood fluid then flows through the perforations 108 of the tubular element and through the screen member 110 into the annulus 118 between the perforate tubular element and well casing or well bore. Thence, the pressurized fluid flows through the casing perforations or through the wall of the well bore into the formation of interest.

Conversely, backflowing fluid from the formation must then flow through the gravel pack screen and through the perforations 108 of the perforate tubular member 106 before it can reach the flow control device. Any particulate matter that might erode the flow control device is then excluded from the backflowing fluid by the screen member 110.

What is claimed is:

1. A fluid injection mandrel and flow control system for connection within a fluid injection tubing string of a well for injection of water and other liquid materials into a subsurface earth formation intersected by a well bore having a well casing, comprising:

(a) a fluid injection flow control mandrel having an upper end adapted for connection to a fluid injection tubing string extending into the wellbore and defining an internal flow passage;

(b) a flow control pocket being located within said mandrel and being adapted for receiving a fluid injection flow control device for controlling pressurized injection of water and other liquid materials from said mandrel into said wellbore, said flow control pocket defining an injection fluid inlet in communication with said internal flow passage, a flow control receptacle for receiving said flow control device and further defining a fluid injection port opening externally of said mandrel; and (c) screen means being supported by said mandrel and being oriented with respect to said fluid injection port for screening fluid flowing into said fluid injection port during conditions of injected fluid backflow from said subsurface earth formation.

2. The fluid injection mandrel of claim 1, wherein:

said screen means being a gravel pack screen positioned to screen particulate from injected fluid flowing from said injection port and backflowing fluid flowing from said subsurface earth formation into said injection port.

3. The fluid injection mandrel of claim 1, wherein:

(a) said mandrel defining a lower end defining a connection for said fluid injection tubing string (b) said fluid injection port being located for injection of water and other fluid from said flow control pocket into the annulus between said fluid injection tubing string and said well casing; and (c) said screen means being a gravel pack screen supported by said mandrel and positioned to screen particulate from fluid flowing from said fluid injection port during fluid injection operations and fluid backflowing from said subsurface earth formation into said annulus and thence into said fluid injection port and through said fluid injection flow control device.

4. The fluid injection mandrel of claim 3, wherein said gravel pack screen comprises:

(a) an elongate perforate tubular member being supported at the upper end thereof by said mandrel; and (b) a gravel pack screen being disposed about said elongate perforate tubular member.

5. The fluid injection mandrel of claim 4, wherein:

said elongate perforate tubular member and said gravel pack screen being located externally of said fluid injection tubing string.

6. The fluid injection mandrel of claim 4, wherein:

said elongate perforate tubular member and said gravel pack screen being adapted for location about said fluid injection tubing string.

7. The fluid injection mandrel of claim 4, wherein:

said elongate perforate tubular member and said gravel pack screen being adapted for location about said fluid injection tubing string and in non-concentric relation with the centerline of said fluid injection tubing string.

8. The fluid injection mandrel of claim 1, wherein:

(a) said mandrel defining a lower threaded end of sufficient internal dimension to receive said fluid injection tubing string in spaced relation therein;

(b) an elongate perforate tubular member defining upper and lower ends and having the upper end thereof threadedly connected to said lower threaded end of said mandrel and being of a dimension for receiving said fluid injection tubing string in spaced relation therein;

(c) a gravel pack screen being fixed about said elongate perforate tubular member.

9. The fluid injection mandrel of claim 8, wherein:

a coupling member being connected to the lower end of said elongate perforate tubular member and having said fluid injection tubing string in connected engagement therewith, said coupling member having said fluid injection tubing string connected in suspended relation therewith.

10. A fluid injection mandrel and flow control system for connection within a fluid injection tubing string of a well for injection of water and other liquid materials into a subsurface earth formation intersected by a wellbore having a well casing, comprising:

(a) a fluid injection flow control mandrel having an upper end adapted for connection to a fluid injection tubing string extending into the wellbore and defining a lower end and an internal flow passage;

(b) a flow control pocket being located within said mandrel and being adapted for receiving a fluid injection flow control device for controlling pressurized injection of water and other liquid materials from said mandrel into said wellbore, said flow control pocket defining an injection fluid inlet in communication with said internal flow passage, a flow control receptacle for receiving said flow control device and further defining a fluid injection port opening externally of said mandrel;

(c) an elongate perforate tubular member extending downwardly from said mandrel; and (d) a screen element being supported about said elongate perforate tubular member and being oriented with respect to said fluid injection port for screening fluid flowing into said fluid injection port during conditions of injected fluid backflow from said subsurface earth formation.

11. The fluid injection mandrel of claim 1, wherein:

(a) said mandrel defining a lower threaded end of sufficient internal dimension to receive said fluid injection tubing string in spaced relation therein;

(b) an elongate perforate tubular member defining upper and lower ends and having the upper end thereof threadedly connected to said lower threaded end of said mandrel and being of a dimension for receiving said fluid injection tubing string in spaced relation therein;

(c) a gravel pack screen being fixed about said elongate perforate tubular member.

12. The fluid injection mandrel of claim 11, wherein:

a coupling member being connected to the lower end of said elongate perforate tubular member and having said fluid injection tubing string in connected engagement therewith, said coupling member having said fluid injection tubing string connected in suspended relation therewith.

13. The fluid injection mandrel of claim 10, wherein:

(a) said mandrel defining a lower end defining a connection for said fluid injection tubing string (b) said fluid injection port being located for injection of water and other fluid from said flow control pocket into the annulus between said fluid injection tubing string and said well casing; and (c) said screen means being a gravel pack screen supported by said mandrel and positioned to screen particulate from fluid flowing from said fluid injection port during fluid injection operations and fluid backflowing from said subsurface earth formation into said annulus and thence into said fluid injection port and through said fluid injection flow control device.

14. The fluid injection mandrel of claim 13, wherein said gravel pack screen comprises:

(a) an elongate perforate tubular member being supported at the upper end thereof by said mandrel; and (b) a gravel pack screen being disposed about said elongate perforate tubular member.

15. The fluid injection mandrel of claim 14, wherein:

said elongate perforate tubular member and said gravel pack screen being located externally of said fluid injection tubing string.

16. The fluid injection mandrel of claim 14, wherein:

said elongate perforate tubular member and said gravel pack screen being adapted for location about said fluid injection tubing string and in non-concentric relation with the centerline of said fluid injection tubing string.

17. The fluid injection mandrel of claim 10, wherein:

(a) said mandrel defining a lower threaded end of sufficient internal dimension to receive said fluid injection tubing string in spaced relation therein;

(b) an elongate perforate tubular member defining upper and lower ends and having the upper end thereof threadedly connected to said lower threaded end of said mandrel and being of a dimension for receiving said fluid injection tubing string in spaced relation therein;

(c) a gravel pack screen being fixed about said elongate perforate tubular member.

* * * * *